United States Patent [19]

Brewer et al.

[11] Patent Number: 4,788,739

[45] Date of Patent: Dec. 6, 1988

[54] WASHING APPARATUS FOR BUNG OF A DRUM

[75] Inventors: Jackie D. Brewer, Modesto; Maynard H. Gartin, Patterson; Frank T. Yoneshige, Stockton, all of Calif.

[73] Assignee: Chesebrough-Pond's Inc., Greenwich, Conn.

[21] Appl. No.: 59,447

[22] Filed: Jun. 8, 1987

[51] Int. Cl.[4] ..... B08B 3/04; B08B 5/04

[52] U.S. Cl. ..... 15/322; 15/321

[58] Field of Search ..... 15/321, 322, 302, 345

[56] References Cited

U.S. PATENT DOCUMENTS

| | | | |
|---|---|---|---|
| 1,046,856 | 12/1912 | Reininger . | |
| 1,151,969 | 8/1915 | Schock . | |
| 1,347,402 | 7/1920 | Reininger . | |
| 2,497,435 | 2/1950 | Branneman | 15/321 X |
| 3,161,900 | 12/1964 | Hornschuch et al. | 15/345 |
| 3,186,132 | 6/1965 | Duncan et al. | 15/322 X |
| 3,482,583 | 12/1969 | Fenn | 134/43 |
| 3,603,328 | 2/1970 | Fenn | 134/43 |
| 3,678,534 | 7/1972 | Hilbig | 15/345 |
| 3,731,340 | 5/1973 | Pitre | 15/345 |
| 4,168,562 | 9/1979 | Maasberg | 15/322 X |
| 4,628,972 | 12/1986 | Rochelle | 141/91 |

FOREIGN PATENT DOCUMENTS

| | | | |
|---|---|---|---|
| 95877 | 4/1960 | Norway | 15/321 |

*Primary Examiner*—Chris K. Moore

*Attorney, Agent, or Firm*—Melvin H. Kurtz

[57] ABSTRACT

A washing apparatus for the bung area of a drum is described which comprises a cover having a peripheral skirt portion comprising a circumferential water conduit containing at least one inwardly directed nozzle to spray water at the area of the bung of the drum for the cleaning of that area of the drum. Water inlet means allow for the infusion of water into the conduit and then through the nozzle or nozzles for the cleaning of the bung area of the drum. A vacuum source is connected to a pipe in an opening in the central portion of the cover to remove washing water supplied to the area of the bung of the drum by the nozzle means within the cover.

7 Claims, 2 Drawing Sheets

FIG.1
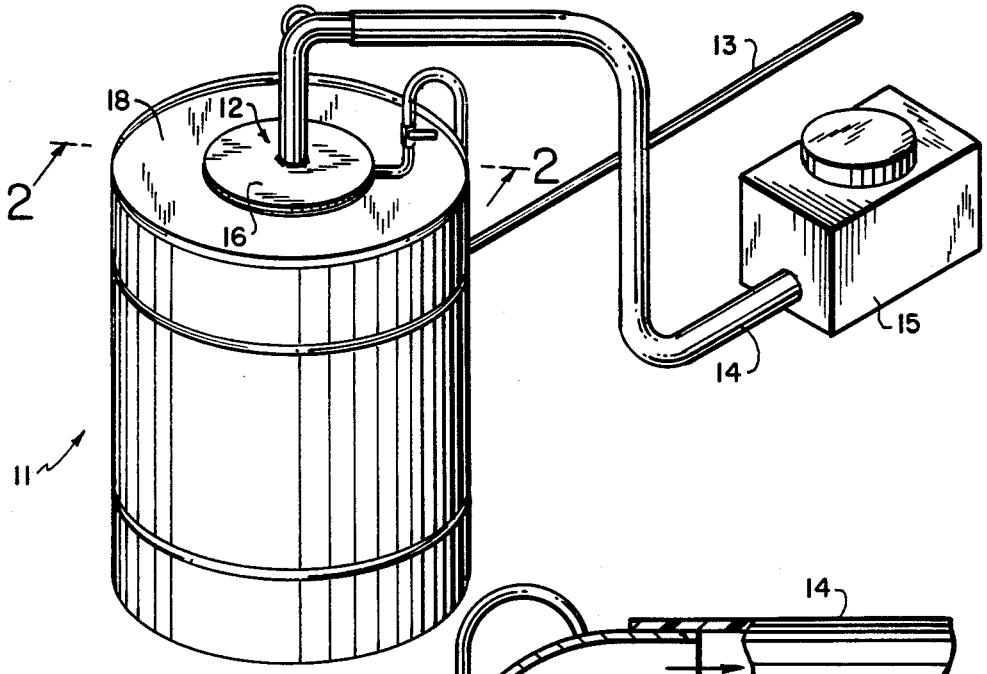
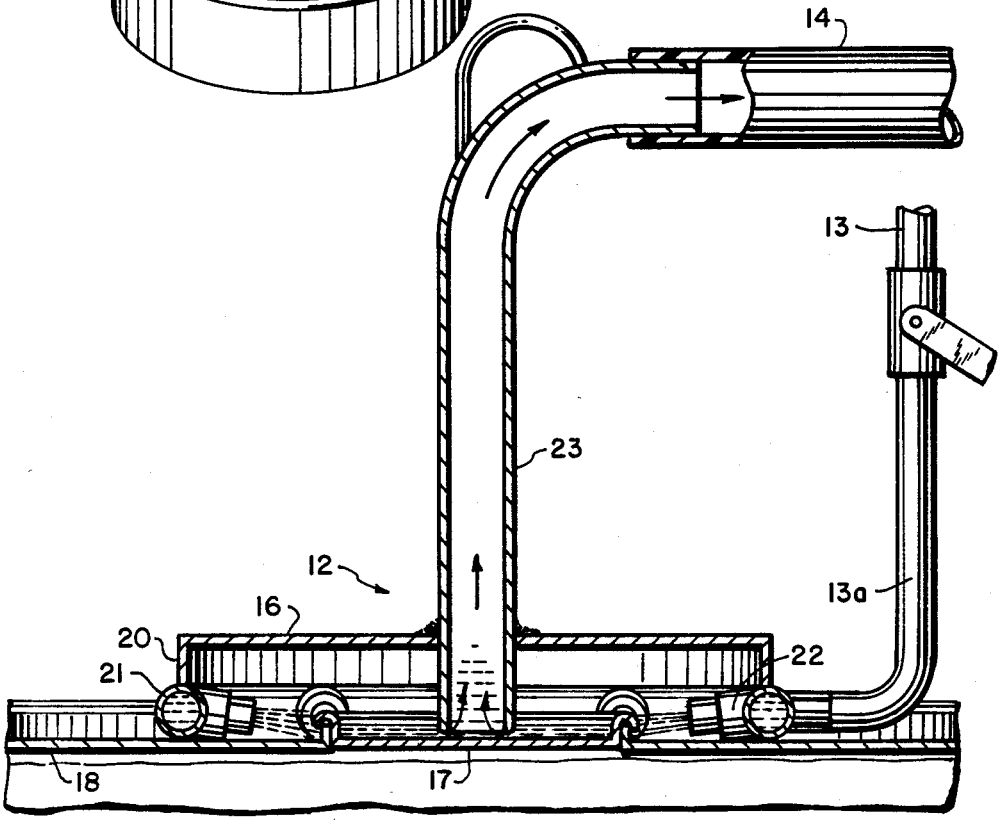
FIG.2

WASHING APPARATUS FOR BUNG OF A DRUM

BACKGROUND OF THE PRESENT INVENTION

The present invention relates to a washing apparatus for the bung of a drum.

The present invention is an apparatus that can be used to clean undesired contamination from the bung area of drum in a simple and efficient way. For example, when food products, such as tomato paste, are placed in drums containing bungs, it is common for some of the product to undesirably become deposited under the surfaces of the bung lip. When the bung is sealed, such product contamination can undesirably become lodged between the bung lip and the drum surface. Over time, this product can become discolored upon spoilage. Such a condition is undesirable.

Hence, a need exists for a simple and efficient way in which the bung area of the drum can be cleaned immediately after sealing of the drum to remove excess product from the area of the bung to allow for a clean drum with no spoiled product under the lip of the bung.

SUMMARY OF THE PRESENT INVENTION

The washing apparatus of the present invention is intended to be used to clean the area around the bung of a drum which can, for example, be intended for the storing and transport of a food product, such as tomato paste. The apparatus comprises a cover which is adapted to cover the bung of a drum and which has a peripheral skirt portion comprising a circumferential water conduit therein. At least one inwardly directing nozzle is in fluid communication with the water conduit so as to be adapted to spray water from the conduit at the area of the bung of the drum for the cleaning of that portion of the drum. Water inlet means are provided which are in fluid communication with the water conduit to introduce water into the conduit and connected nozzle or nozzles for cleaning of the bung area of the drum. A pipe is connected to an opening in the central portion of the cover so that a vacuum source connected to the exterior end of the pipe can remove water from the area of the bung after that area has been cleaned with water supplied from the nozzle or nozzles.

DESCRIPTION OF THE DRAWINGS

The present invention will be more fully understood by reference to the Drawings which further illustrate the present invenion wherein:

FIG. 1 is a perspective view showing the washing apparatus of the present invention in place on a drum and connected to appropriate conduits supplying water and vacuum;

FIG. 2 is a cross-sectional view of the washing apparatus of the present invention taken along lines 2—2 of FIG. 1;

DETAILED DESCRIPTION OF THE PRESENT INVENTION

Figure 3:
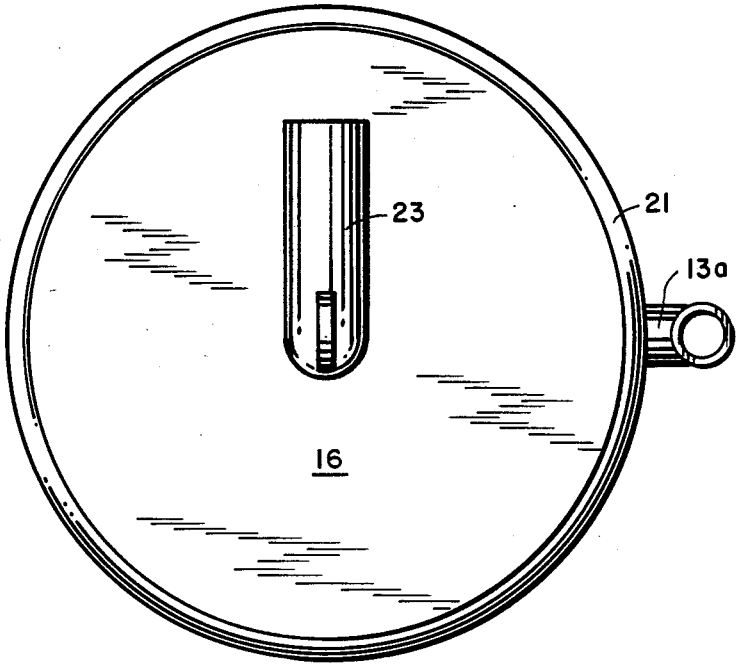
FIG. 3 is an overhead view of the washing apparatus of the present invention.

FIGS. 1 and 2 show how the washing apparatus of the present invention is used to clean the bung area of a drum. In FIG. 1, a drum 11 contains the washing apparatus 12 of the present invention over a bung on its upper surface. The apparatus 12 is appropriately connected to a water conduit inlet 13 and another conduit 14 connected to a vacuum source 15. As will be described in greater detail below, the water inlet 13 supplies water to inlet pipe 13a and performs the washing function. Water pressures of several hundred pounds per square inch (e.g., about 600 psi) can be used. The vacuum inlet 14 and vacuum source 15 provide suitable vacuum to remove the water (and any dissolved undesired contaminating material) resulting from the washing operation from the area of the bung.

FIG. 2 shows the apparatus of the present invention in greater detail. It comprises a cover 16 which is adapted to cover a bung 17 in the surface 18 of drum 11.

Figure 4:
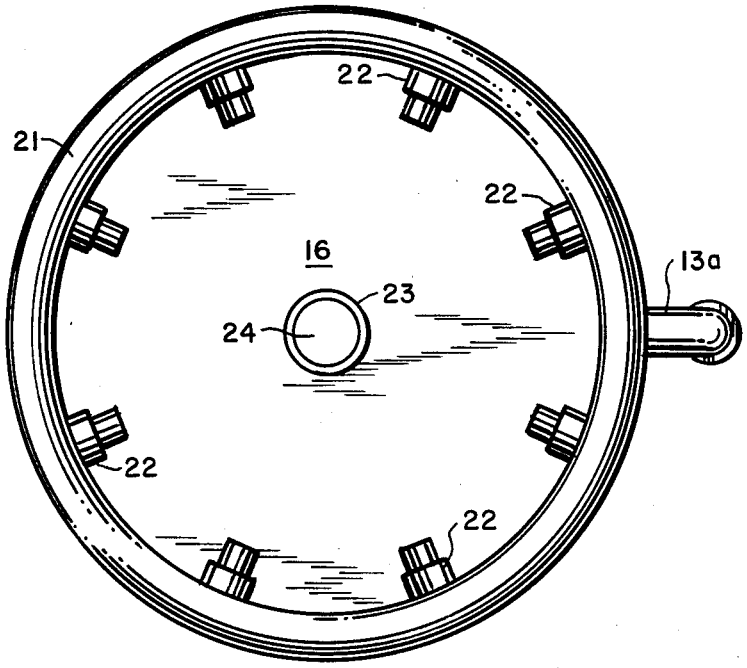
FIG. 4 is a view of the apparatus of the present invention from the bottom.

The cover 16 of washing apparatus 12 has a peripheral skirt 20 which comprises a circumferential water conduit 21 therein. The conduit 21 can be integrally a part of the lower portion of the skirt 20 and can extend around the entire periphery of the skirt. The water conduit 21 has at least one inwardly directed nozzle 22 which is adapted to spray water at the area of the bung 17 for the cleaning of that area of the drum 11. FIG. 4 of the Drawings illustrates an embodiment wherein eight inwardly directed nozzles 22 are pointed at the center portion of the cover 16 of the washing apparatus 12. The nozzles 22 are in fluid communiction with conduit 21 on the exterior of the skirt 20 which in turn is connected to the water inlet 13 via inlet pipe 13*a*.

In order to achieve the easy removal of water supplied through water inlet 13, inlet pipe 13*a*, conduit 21, and nozzle or nozzles 22, the washing apparatus 12 of the present invention has a pipe 23 extending through an opening 24 in the central portion of cover 16. This pipe is connected to a vacuum conduit 14 which is, in turn, connected to a source of vacuum 15. When the device is used to wash the bung area of the drum 11, the supply of vacuum through conduit 14 and pipe 23 acts to suck out most of the water (and any entrained, undesired material contained therein from the cleaning operation) supplied during the washing step, as shown in the arrows in FIG. 2. Termination of supply of water and the continuation of the vacuum will result in a suitably dried environment around the bung. At this point, the bung 17 area of the drum is clean.

The foregoing represents certain embodiments of the present invention but should not be construed in a limiting sense. This scope of protection that is sought is set forth in the claims which follow.

I claim:

1. A washing apparatus for the area of the bung of a drum which comprises:

(a) a cover, adapted to cover the bung of the drum, having a peripheral skirt portion comprising a circumferential water conduit;

(b) at least one inwardly directed nozzle in fluid communication with the circumferential water conduit to spray water from the conduit inwardly at the area of the bung for cleaning thereof;

(c) water inlet means in fluid communication with the water conduit to introduce water into the conduit to supply the water to the nozzle for cleaning of the area of the bung; and (d) a pipe passing through an opening in the central portion of the cover adapted to be connected to a vacuum source to remove water from the area of the bung when that area has been cleaned by water supplied from the nozzle.

2. An apparatus as claimed in claim 1 wherein the water conduit is at the lower portion of the skirt of the cover.

3. An apparatus as claimed in claim 1 wherein the water conduit extends completely around the periphery of the skirt.

4. An apparatus as claimed in claim 1 wherein the water conduit is an integral part of the skirt at the lower portion thereof and extends completely around the periphery of the skirt.

5. An apparatus as claimed in claim 4 wherein the water inlet means are positioned on the exterior surface of the skirt.

6. An apparatus as claimed in claim 1 wherein the water inlet means are positioned on the exterior surface of the skirt.

7. An apparatus as claimed in claim 1 wherein the nozzle points at the center of the apparatus.

* * * * *